United States Patent [19]

Jabouri

[11] Patent Number: 4,754,768

[45] Date of Patent: Jul. 5, 1988

[54] HAIR PLUCKING MECHANISM

[76] Inventor: Jal H. Jabouri, 37 Urbandale Ave., Willowdale, Ontario, Canada, M2M 2G9

[21] Appl. No.: 946,854

[22] Filed: Dec. 29, 1986

[51] Int. Cl.[4] ..... A45D 1/00

[52] U.S. Cl. ..... 132/9

[58] Field of Search ..... 132/73, 73.5, 73.6, 132/76.2, 9; 128/354, 355; 17/11.1 R, 47

[56] References Cited

U.S. PATENT DOCUMENTS 1,588,387 12/1923 Li et al. ..... 128/355

*Primary Examiner*—Robert Peshock
*Assistant Examiner*—R. Thomas Price
*Attorney, Agent, or Firm*—Donald E. Hewson

[57] ABSTRACT

A string manipulating mechanism has a first tensioned string and a second roller string having several turns thereof coiled about a central portion of the first string. An oscillator mechanism see-saws the ends of the second string, causing the coiled turns to form an interaction zone that advances and recedes along the tensioned first string, while simultaneously twisting the first string to and fro. In use, application of the oscillating and twisting strings to the skin of a subject entrains hairs of the subject about the tensioned string, simultaneously plucking out and discarding the plucked hair as the interaction zone of the meshing strings oscillates to and fro on the main axis of the first string. An alternative embodiment comprises a pair of endless string loops continuously driven in uni-directional intermeshing relation.

11 Claims, 3 Drawing Sheets

HAIR PLUCKING MECHANISM

BACKGROUND OF THE INVENTION

This invention is directed to a hair plucking mechanism, and in particular a string tensioning and twisting mechanism for use in entraining and plucking hair.

The removal of unwanted hair from the face, hands, arms and legs has been practiced, particularly by females as a beauty treatment, over many centuries.

The many methods that have been practiced include:

shaving or scraping, in the manner widely practiced by men, using blade razors, electric shavers, and equivalents;

waxing, using a coherent wax layer to which the hair adheres;

chemical depilation, using a chemical which attacks the hair;

tweezers, seizing individual hairs for manual extraction;

electrolysis, using an electrically charged needle to kill the hair roots, individually; and stringing, wherein a hand held string is rotated by an entrained portion of the string, held by a skilled operator to entrap and extract the hair.

These different methods each have certain advantages and disadvantages. Shaving is fast, convenient and generalized, but promotes rapid growth, and hair coarsening.

Waxing is thorough and effective, but is time consuming, messy and painful at the time of stripping the hair along with the wax.

Chemical depilation is convenient, but presents certain dangers to sensitive skins, and may be unpleasantly odiferous.

Tweezers are extremely effective, but very slow, tiresome and can be quite painful and nerve wracking.

Electrolysis requires a skilled operator and special apparatus. It is effective, but expensive and time consuming.

Stringing requires the services of a second person, skilled in manipulating the strings (a "Haffafa" in Arabic). After stringing, the rate of hair regrowth is slow, as the root usually has also been pulled; and the regrown hairs tend to become progressively finer with successive stringings. However, manual manipulation of a "string" requires the use of both hands and the mouth of the Haffafa; and virtually precludes self administration except in the simplest instances.

SUMMARY OF THE INVENTION

The present invention provides a string manipulating mechanism whereby the removal of hair by string entrainment can be practiced by an unskilled person, and by the user on their own body.

The present invention provides a string manipulating mechanism for pulling body hair from a subject, the mechanism comprising a body portion; first string support means for extending a first run of string; second string support means for extending a second run of string; a first string positioned by the first string support means; a second string having a portion thereof in coiled relation about a portion of the first string and positioned by the second string support means; and driving means for producing relative movement between the strings to cause travel of the coiled portion of the second string, in use to entrain hairs of a subject in trapped relation therewith.

In some embodiments there is provided a string manipulating mechanism for pulling hair from a subject, the mechanism comprising a body portion, stretcher means extending therefrom having a pair of spaced apart first end portions for the suspension of a first string therebetween; oscillator means supported by the body portion having a pair of spaced apart second end portions for the attachment of a second string thereto; a first string of predetermined thickness suspended between the first end portions; a second string having a portion intermediate the ends thereof wound by way of a plurality of turns about a central portion of the first string and connected by intervening end portions to the oscillator means second end portions in tensioned relation; and means for oscillating the oscillator means so as to successively increase and decrease the respective lengths of the second string intervening end portions and correspondingly advance and retract the turns of the second string along the first string in twist-inducing relation with the first string, in use to engage hairs of a subject in entrained relation therewith, to further roll up the hair to the point of extraction, and to discard the thus extracted hair.

The first string may be directly tensioned or tensioned by the second string. The fineness of the strings is usually selected with regard to the coarseness of hair to be dealt with, coarser string being required for thicker, stronger hair.

Experience has shown that the subject mechanism is effective in the removal of hair. The mechanism is self cleaning, at least in the case of normal length hairs, which are sequentially dropped as a consequence of the continually reversing movements of the two strings.

The subject apparatus is suitable for manufacture in a number of alternative embodiments. One embodiment comprises a portable, hand-held trigger operated apparatus, of simple low cost components. Another embodiment incorporates an electric motor characterized by low power requirements, suitable for use with batteries, including the rechargeable type. The mechanized versions have been found to function effectively with an output speed of about 60 to 120 revolutions per minute, to produce a corresponding rate of string oscillation.

Tests have been carried out using two separate looped strings running continuously in intermeshed relation. However, the complexity and mechanical losses in the driving and guiding provisions for the strings make this alternative embodiment less desireable at present than the embodiments disclosed herein.

BRIEF DESCRIPTION OF THE DRAWINGS

Certain embodiments are described, reference being made to the accompanying drawings, wherein.

DETAILED DESCRIPTION OF EMBODIMENTS

Figure 1:
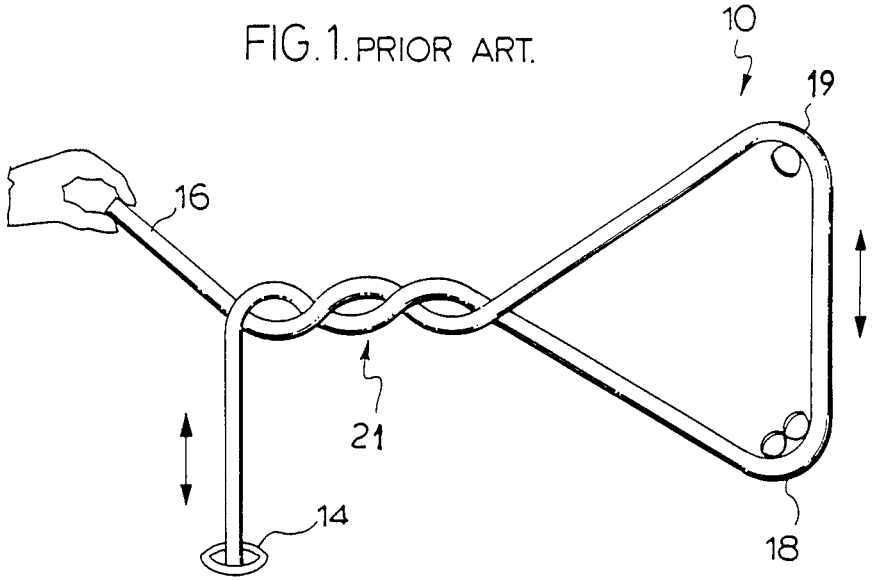
FIG. 1. PRIOR ART.
FIG. 1 is a schematic diagram illustrating the PRIOR ART manipulation of a string as practiced by a Haffafa.

In FIG. 1, the arrangement 10 shows schematically how a single string 12 is used by a Haffafa, having one end 14 held in the teeth, the other end 16 held by one hand (illustrated as being the left hand, but not imperatively so) the bight 18 passing about the thumb of the other (right) hand, and the bight 19 passing about the first and second fingers of the other right hand.

The string is twisted about itself, and provides a coiled region 21.

To operate the string, the Haffafa opens and closes the involved fingers and thumb of the right hand in movements that are synchronized with back-and-forth movements of the head. This causes the coils of the string to oscillate leftwardly in response to a backward, tensioning head motion and a simultaneous forward releasing motion of the thumb. Reversal of the thumb and head motion, while maintaining the string under tension, rotates the coils so as to travel rightwardly.

With rhythmic repetitions, the string gives an impression of becoming elastic, due to the smoothness of the to and fro oscillations, at which time the intertwined string portion is brought into contact with, and swept across, the skin of the subject being treated. This entrains, plucks and discards hairs traversed by the intertwined string, by the action of the intertwining string coils catching and rolling the hair (entrainment), retaining engagement of the hair so as to pull it from the skin (plucking), and then freeing the pulled hair from the string coil as it either passes by that portion of the string where the hair is caught or by reversal of the string coil oscillatory motion (discarding).

Figure 2:
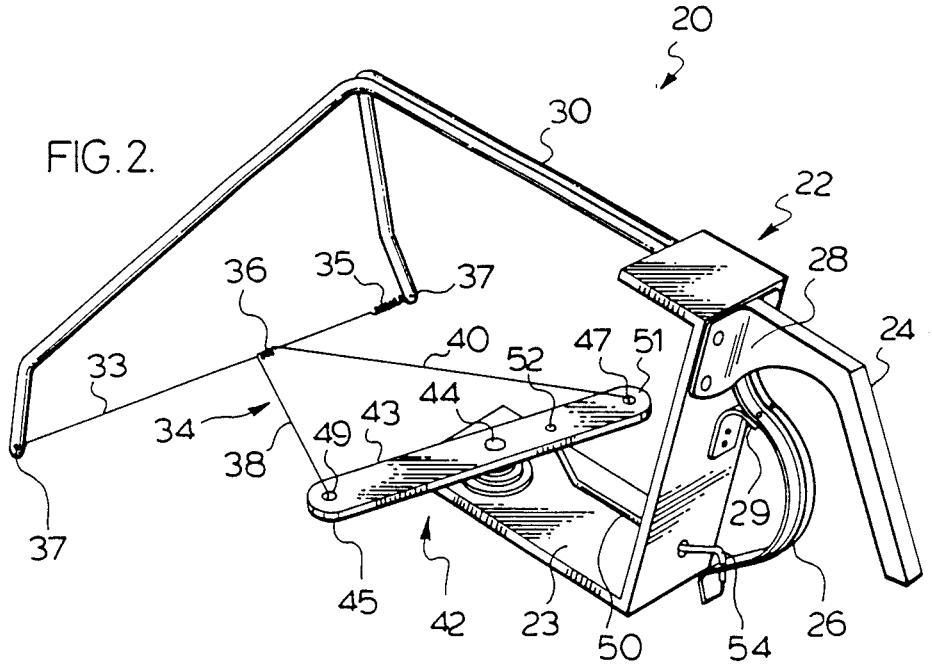
FIG. 2 is a general view of a hand held manually operated string manipulating mechanism in accordance with the present invention.

Turning to FIG. 2 the arrangement 20 comprises a U-shaped frame 22 having a handle 24 extending therefrom; and a trigger 26 pivotted at 28, having a return spring 29. A boom portion 30 extending from the frame 22 connects with a pair of bifurcated legs 32 that constitute a stretcher means. A first string 33 tensioned by spring 35 extends between attachment apertures 37 of the stretcher means.

A second string 34 has coils 36 thereof wound about string 33 in entwined relation therewith. Intervening string portions 38, 40 of the string 34 are secured to an oscillator means 42.

The oscillator means 42 comprises a bar 43 pivotably mounted at axis 44 to a portion 23 of the frame 22.

The opposite ends of bar 43 comprise second end portions 45, 47 having apertures 49, 51 to which the respective string portions 38, 40 are secured.

A link 50 extends in substantially rigid interconnecting relation between spring loaded trigger 26 and oscillator bar 43. The ends of link 50 are respectively pivotably connected at 52 to the bar 43; and at 54 to the trigger 26. The flat biassing spring 29 secured to handle 24 depresses the trigger 26 in forward pressing relation, to extend link 50 forwardly, whereby the string portion 40 is diminished and the string portion 38 is extended.

The handle 24 is gripped by a user's hand, the trigger 26 being encircled by the index finger, for repeated pulling and releasing of the trigger 26.

As the oscillator bar 43 pivots about its axis 44, on release by the users index finger of trigger 26, under spring tension, the length of string portion 38 increases by pulling turns off the coils 36. Simultaneously, the string portion 40 shortens as it is pulled in coiling relation to replace the coils 36. Consequently the coils 36 move leftwardly, simultaneously twisting the first string 33.

Pulling of the trigger 26 by the user reverses all these motions, to lengthen string portion 40 of the second string 34 and pull the coils 36 in "running" relation rightwardly along the first string 33, while simultaneously reversing the twist of string 33.

Thus the string interaction zone, comprising the coils 36, traverses to and fro along a portion of the length of the first string 33, while simultaneously twisting and reverse twisting that string.

Application of this interaction zone of the strings 33, 34 against the skin of a user serves to trap and wind the hairs about the first string 33. The combined twisting of string 33 and displacement of string coils 36 along the axis of string 33 serves to smoothly pluck the entrained hairs. Subsequent reversal, or continued coiling motion of the strings clear of the entrained hair, then discards the plucked hairs.

Figure 3:
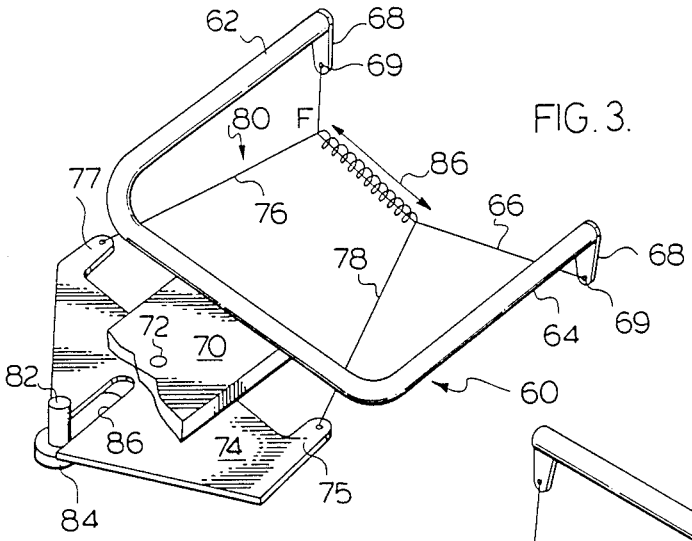
FIG. 3 is a general view of the functional components of a further embodiment incorporating a rotary action.

In FIG. 3 there is illustrated a U-frame 60, the resilient legs 62, 64 of which serve to tension the first string 66. A pair of plates 68 having apertures 69 receive the ends of string 66.

An arm 70 from which the frame 60 is suspended has a downwardly depending pivot pin 72 on which is mounted a rocker arm 74 in pivotal relation therewith. The rocker arm 74 has end portions 75, 77 to which the ends 76, 78 of the second string 80 are secured.

A crank pin 82 at the end of rotatable crank shaft 84 engages in slot 86 of rocker arm 74.

Rotation of crank shaft 84 produces oscillation of rocker arm 74 about its pivot pin 72, thus oscillating the second string 80 and correspondingly displacing the string interaction zone to and fro as indicated by the double headed arrow 86.

Figure 4:
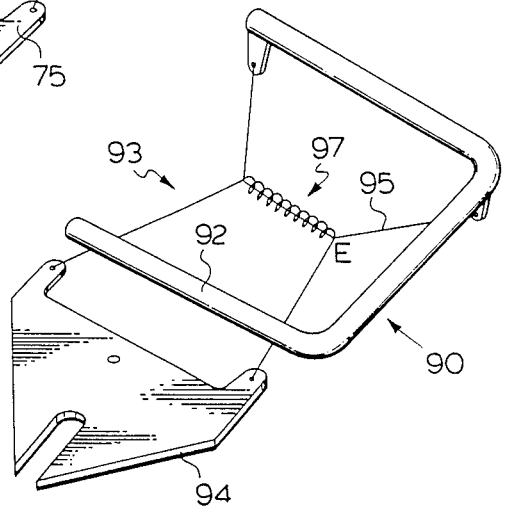
FIGS. 4 and 5 are general views of alternative frame arrangements of the subject invention.

FIG. 4 shows an alternative frame arrangement having a U-shaped frame 90, of which the leg 92 is used to attach the frame 90 to the body of the device (not shown). A pivotted rocker arm 94 having the second string 93 secured thereto, is illustrated.

The first string 95 is illustrated as being tensioned by the second string 93. The string interaction zone 97, shown in a somewhat extended form, oscillates in time with the rocker arm 94, in the same fashion as before.

Figure 5:
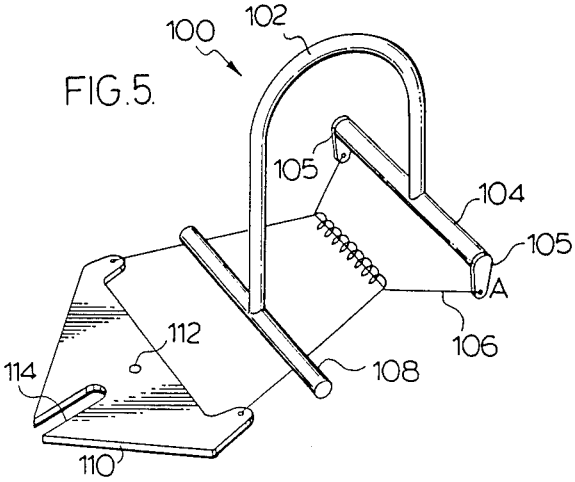

In FIG. 5 the frame embodiment 100 incorporates a resilient hoop 102 having a transverse frame member 104 with brackets 105 to which the first string 106 is attached.

A second transverse frame member 108 is used to attach the frame 100 to the body of the device (not shown), to which the rocker arm 110 also is pivotted at 112. The rocker arm 110 has a driving slot 114 to receive a crank pin (not shown), in the manner of the FIG. 3 embodiment.

Figure 6:
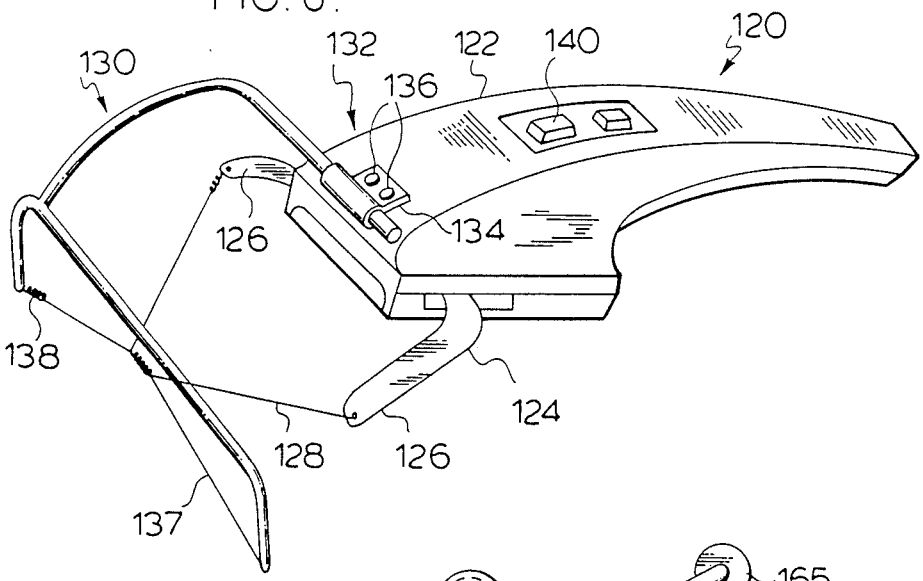
FIG. 6 is a general view of an electrically powered embodiment of the subject mechanism; and embodiment of the subject mechanism.

FIG. 6 shows a powered embodiment 120 having a body portion 122 containing a battery, a battery driven motor and a reduction gear connected in driving relation with a rocker arm 124 having laterally extending arms 126 to which the second string 128 is attached. A frame 130 is adjustably attached at 132 to the body 122, by way of a clamp 134 and adjustable cap screws 136, which permit the frame 130 to be removed or adjusted.

The first string 137 is carried by frame 130 in tensioned relation, by way of spring 138. Operation of the device 120 is controlled by switch 140.

Figure 7:
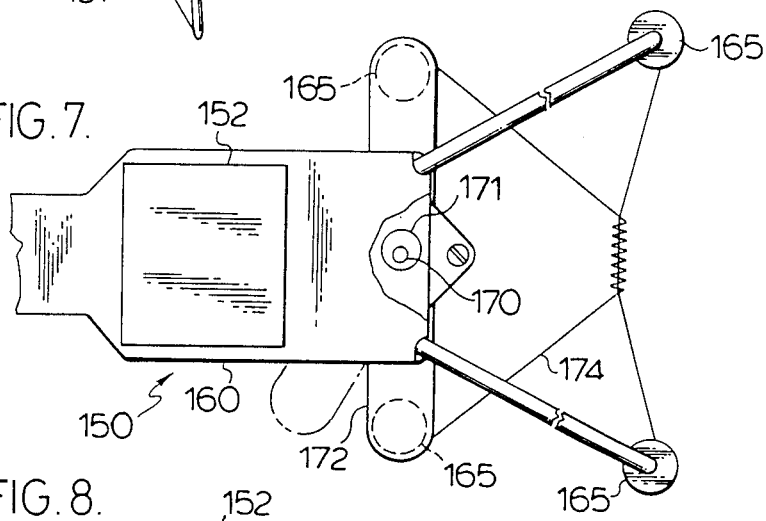
FIG. 7 is a plan view, in part section of another powered embodiment.
Figure 8:
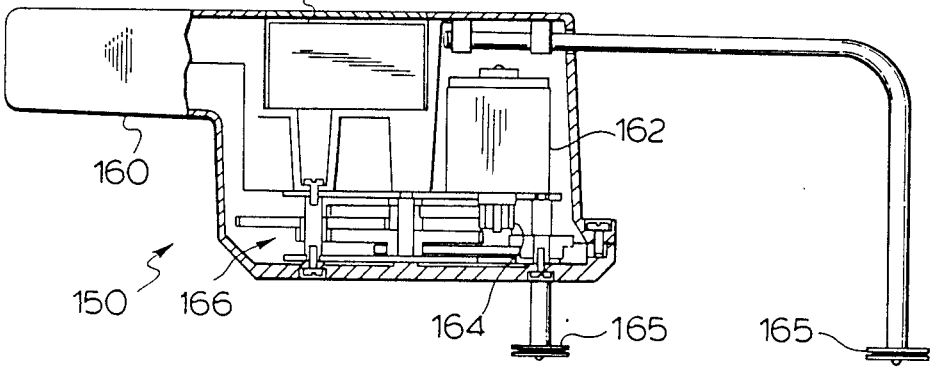
FIG. 8 is a side view, in part section of the FIG. 7 embodiment.

In the arrangement shown in FIGS. 7 and 8, the device 150 is powered by a power pack 152. The battery 152 can be a rechargeable battery.

A casing 180 shown in partial section, contains an electric motor 162, the output gear 164 of which is connected in driving relation with a multi-stage reduction gear 166. The simple, multi-stage reduction gear 166 provides a low output torque at about 60 to 120 r.p.m. to the crankshaft 170, driving a circular cam 171 as illustrated in FIG. 7 to oscillate the rocker arm 172 and second string 174.

The rocker arm 172 is also shown in phantom in FIG. 7 at its two limiting positions.

In the FIGS. 7 and 8 embodiment the two strings are illustrated as being secured to the respective tensioning structures by way of the buttons 165. The buttons 165 each comprise a pair of opposed resilient circular discs forming a V-groove therebetween into which the respective strings are shown, in wedged secured engagement therein. However, it should be understood that alternative methods such as knotting are also effective.

The substitution for the low voltage batteries 152 of a power pack such as a transformer/rectifier arrangement operating at a suitable, safe low voltage also is contemplated.

What is claimed is:

1. A string manipulating mechanism for pulling body hair from a subject, said mechanism comprising a body portion;

first string support means having end portion for extending a first string therebetween;

second string support means for extending a second string;

the first said string being positioned in tension and in a substantially uncoiled fashion between said first string support means;

the second said string having a portion thereof in coiled relation around an uncoiled portion of said first string and positioned by said second string support means;

and oscillatory driving means for producing relative coiling movement of said second string around said first string, in use to entrain hairs of a subject in trapped relation therewith.

2. The mechanism as set forth in claim 1, said driving means including an oscillating portion connected to said second string support means, to cause a plurality of turns of said second string to travel to and fro along said first string in twist inducing relation therewith.

3. The mechanism as set forth in claim 2, including spring means supporting said first string in tensioned relation between said end portions of said first string support.

4. The mechanism as set forth in claim 2, said first string support means including stretcher means having end portions to support said first string in tensioned relation therebetween.

5. The mechanism as set forth in claim 2, wherein said driving means comprises manually actuable trigger means for oscillating said oscillating portion.

6. The mechanism as set forth in claim 5, wherein said trigger means includes a return spring.

7. The mechanism as set forth in claim 1, wherein said oscillatory driving means comprises mechanical drive means.

8. The mechanism as set forth in claim 1, wherein said oscillatory driving means includes an electric motor.

9. The mechanism as set forth in claim 8, wherein said electric motor is battery driven.

10. The mechanism as set forth in claim 8, wherein said electric motor is energized by a power pack.

11. The mechanism as set forth in claim 10, wherein said power pack includes transformer means for attachment thereof to an electrical supply.

* * * * *